United States Patent [19]

Freeman et al.

[11] Patent Number: 5,050,758

[45] Date of Patent: Sep. 24, 1991

[54] SPILL-PROOF CLOSURE FOR A BEVERAGE CONTAINER

[76] Inventors: Mark A. Freeman, 15317 W. 91st Pl., Lenexa, Kans. 66219; Timothy K. Stringer, 8921 W. 80th, Overland Park, Kans. 66204

[21] Appl. No.: 615,805

[22] Filed: Nov. 16, 1990

[51] Int. Cl.[5] ..... A47G 19/22

[52] U.S. Cl. ..... 220/90.4; 220/90.2; 220/254; 220/85 SP; 222/570

[58] Field of Search ..... 220/85 SP, 90.2, 90.4, 220/254, 90.6; 222/212, 566, 570, 571; 215/11.1, 11.4

[56] References Cited

U.S. PATENT DOCUMENTS

| | | | |
|---|---|---|---|
| 3,372,832 | 3/1968 | Yeater et al. | 222/570 |
| 3,905,512 | 9/1975 | Albert et al. | 220/90.4 |
| 3,964,631 | 6/1976 | Albert | 220/90.4 |
| 4,121,731 | 10/1978 | Okerstrum | 220/90.4 |
| 4,138,033 | 2/1979 | Payne et al. | 220/254 |
| 4,184,604 | 1/1980 | Amberg et al. | 220/254 |
| 4,190,174 | 2/1980 | Haimowitz | 220/254 |
| 4,238,045 | 12/1980 | D'Andria | 220/90.4 |
| 4,245,752 | 1/1981 | Prueher | 220/266 |
| 4,361,249 | 11/1982 | Tuneski et al. | 220/254 |
| 4,582,214 | 4/1986 | Dart et al. | 220/90.4 |
| 4,756,440 | 7/1988 | Gartner | 220/90.4 |
| 4,782,975 | 11/1988 | Coy | 220/90.4 |
| 4,796,774 | 1/1989 | Nabinger | 220/85 SP |
| 4,946,062 | 8/1990 | Coy | 220/90.2 |

*Primary Examiner*—Stephen Marcus
*Assistant Examiner*—Paul Schwarz

[57] ABSTRACT

A spill-proof closure for containers used in dispensing liquid beverages. The closure contains an opening for delivery of a contained beverage. The closure also includes a sealing member and a deflectable member. Together these parts form a flow control valve which is normally closed, but opens when external lip pressure is applied during normal drinking.

18 Claims, 4 Drawing Sheets

SPILL-PROOF CLOSURE FOR A BEVERAGE CONTAINER

BACKGROUND

1. Field of Invention

This invention relates to a closure for a beverage container and is particularly concerned with closures which remain in place while drinking and are spill-proof.

2. Description of Prior Art

In some prior art arrangements, the closures have a spout containing an opening typically in the form of a slit or a plurality of apertures. These openings provide a flow passage for withdrawal of the contained liquid and reduce the amount of liquid that spills if the container is tipped or overturned. The disadvantage of prior art arrangements of this approach is the spillage is only reduced, not eliminated.

Another approach to the problem has been to provide a valved spout arrangement. However, prior art embodiments of this approach are relatively complex, multi-piece structures which do not lend themselves to mass production methods. Also, a flexible spout is required for these devices to function properly and flexible spouts are not always desirable.

OBJECTIVES AND ADVANTAGES

The main objective of the present invention is to provide a closure which overcomes the disadvantages previously stated.

Another objective of the present invention is to provide a closure for a container, specifically designed to handle liquid beverages, containing an aperture that communicates between the interior and exterior of said container only when withdrawal of the liquid beverage is desired.

It is a further objective of the present invention to provide a means in which lip pressure is used to open said aperture and when lip pressure is released said aperture automatically closes.

DRAWING FIGURES

REFERENCE NUMERALS IN DRAWINGS

Figure 1:
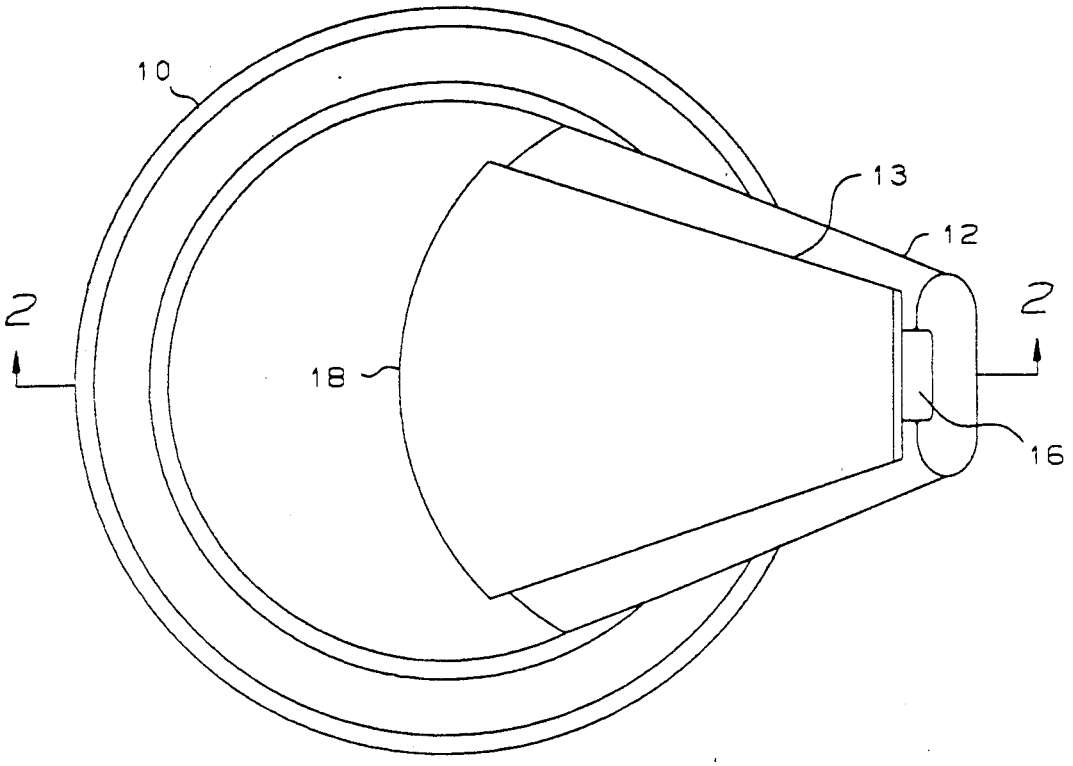
FIG. 1 is a top view of a spill-proof closure in the closed position.

10 Closure
11 Beverage Container
12 Spout
13 Deflectable Member
14 Sealing Member
15 Opening
16 Recessed Area
17 Central Passageway
18 Intersection of Closure and Deflectable Member
19 Stem

DESCRIPTION - FIGS. 1—4B

Referring to the drawings the spill-proof closure of the present invention is indicated as reference numeral 10, and the container is numeral 11. The closure 10 may be made of formable materials such as polypropylene, polyethylene, or the like and is intended to be reusable. The container 11 may also be formed using materials of the same type.

As shown in the drawings, the closure 10 is circular in shape, having a substantially planar cover portion and a raised outer peripheral edge portion. The closure 10 may vary in size depending upon the size of the container 11.

Figure 2:
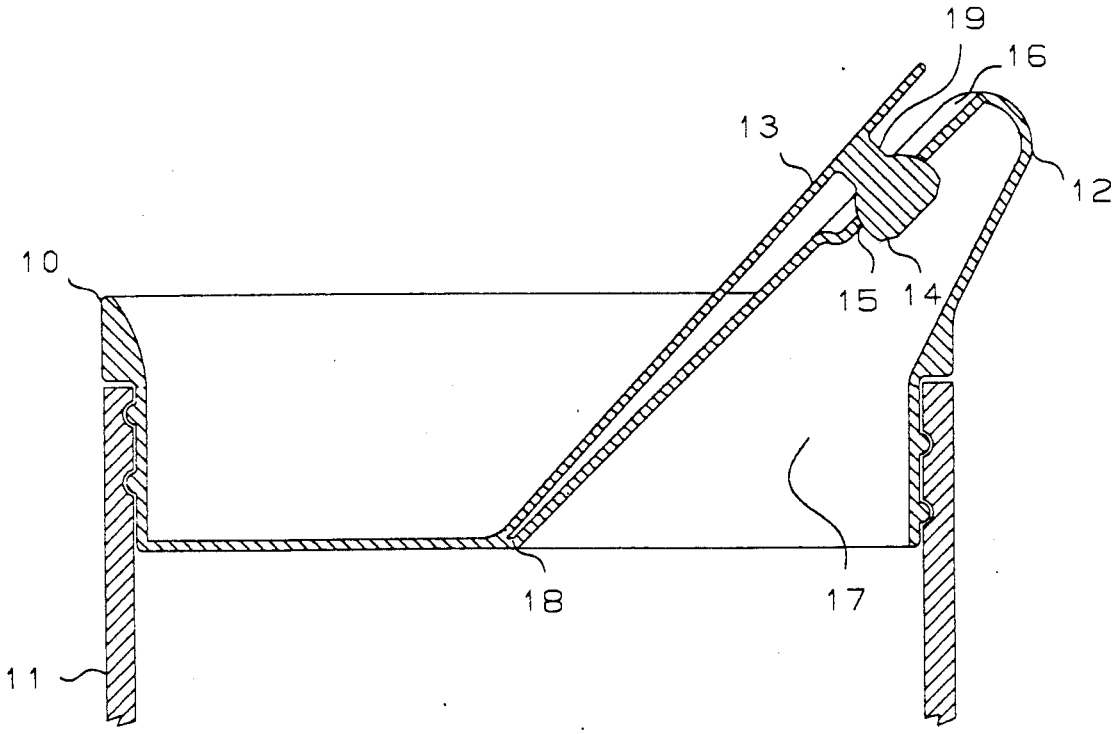
FIG. 2 is the cross-sectional view taken as indicated by section line 2—2 applied to FIG. 1.
Figure 2A:
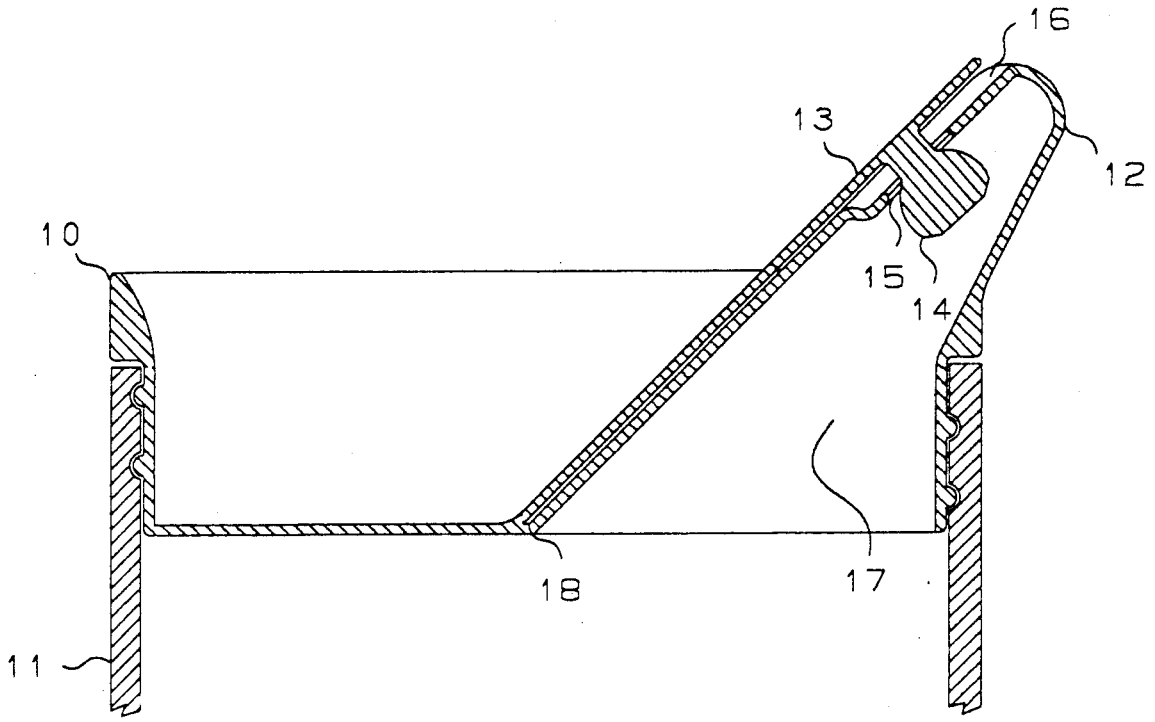
FIG. 2A is the cross-sectional view in FIG. 2, but FIG. 2A shows the closure in the opened position as a result of lip pressure applied by the user.
Figure 2B:
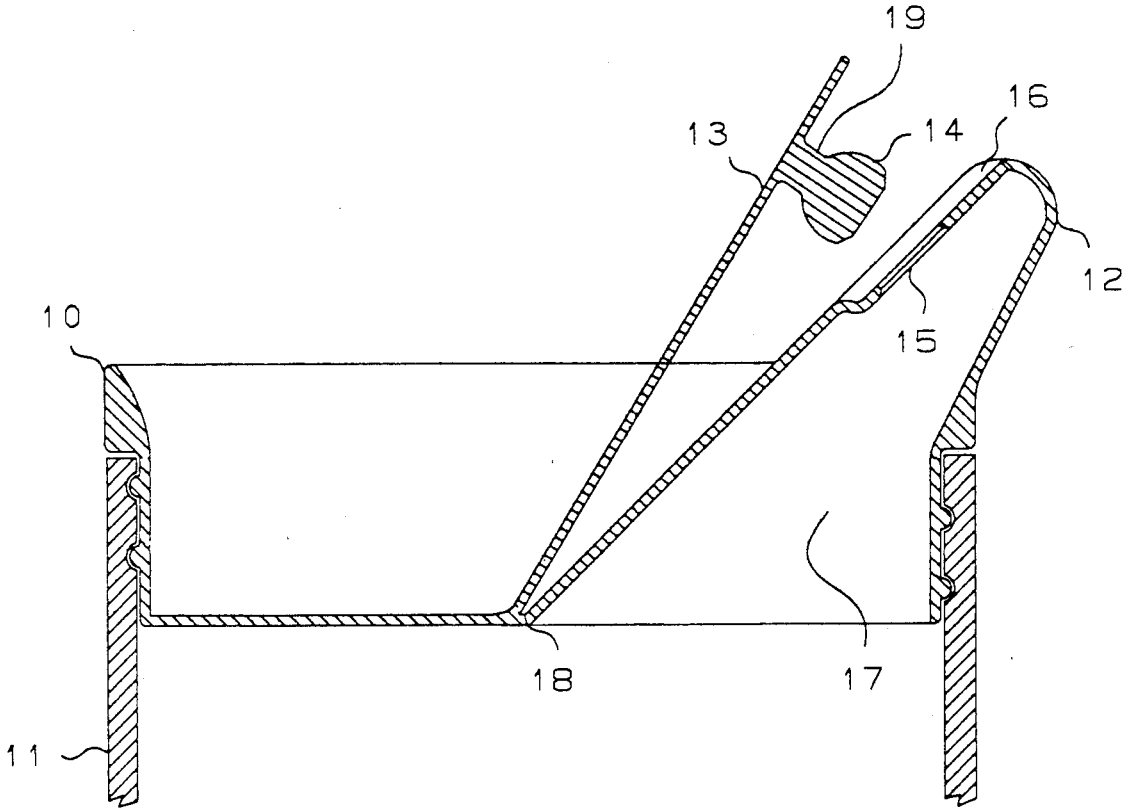
FIG. 2B is the cross-sectional view in FIG. 2, but FIG. 2B shows the closure in the manufactured position.

Referring to FIGS. 1 through 2B, the spout 12 is an integral part of the closure 10 and extends outwardly from the top surface thereof and near the outer periphery thereof. The spout 12 is generally ovoid in cross-section and has a central passageway 17 which is open at the lower end so as to communicate with the interior of the container 11. The spout 12 is generally closed except for opening 15 which is towards the radially inward side of the closure 10 near the outer end of the spout 12. Also near the outer end of the spout 12 on the radially inward side of the closure 10 is a recessed area 16. In the open position shown in FIG. 2A, the recessed area 16 and the deflectable member 13 form a flow passage between opening 15 and the upper end of the spout 12.

The deflectable member 13, which is generally rectangular in cross-section, is an integral part of or attachable to the closure 10. The deflectable member 13 extends outwardly from the top surface of the closure 10, and more specifically from the location designated by numeral 18 which is the intersection of the top surface of the closure 10 and the lower end of the spout 12 on the radially inward side of closure 10. In the open position shown in FIG. 2A, the deflectable member 13 is approximately parallel to the spout 12. In the manufactured and closed positions, FIG. 2B and FIG. 2 respectively, the dimension between the spout 12 and the deflectable member 13 progressively increases from the top surface of the closure 10 to the end of the spout 12. This dimensional increase is greater in the manufactured position.

The sealing member and stem are indicated as reference numerals 14 and 19 respectively, and both are an integral part of or attachable to the deflectable member 13. The sealing member 14 is separated from the deflectable member 13 by the stem 19, and is approximately hemispherical in shape. The diameter of sealing member 14 may range from 0.100 to 0.400 inches and shall be 0.001 to 0.010 inches larger than the diameter of opening 15.

Figure 3:
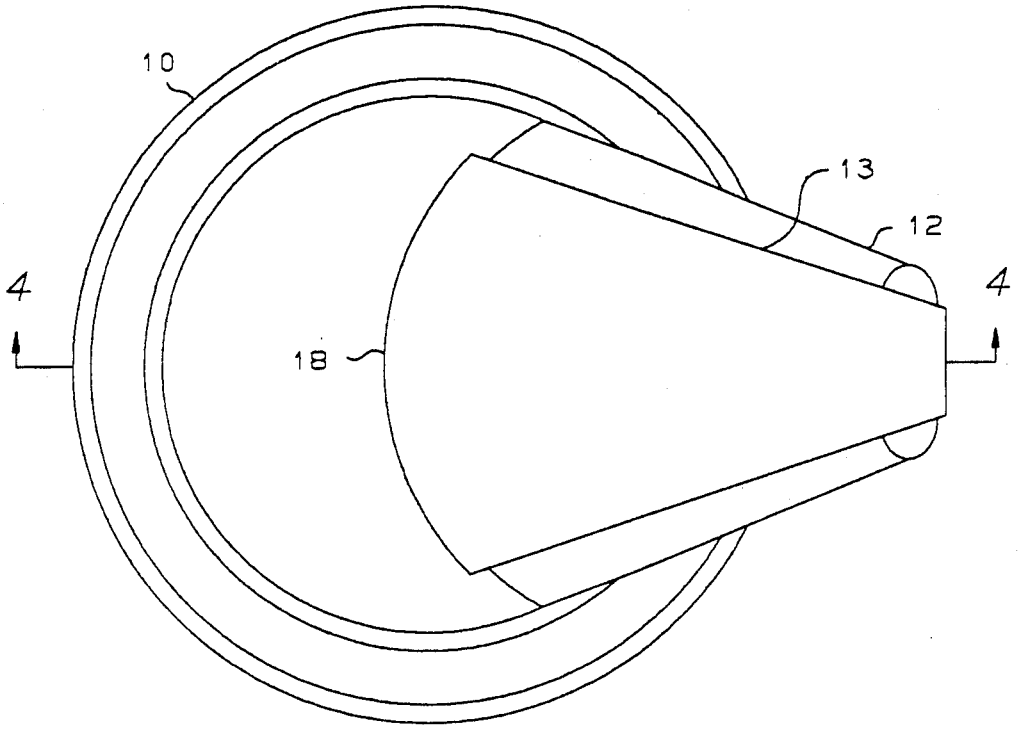
FIG. 3 is a top view of a modified spill-proof closure in the closed position.
Figure 4:
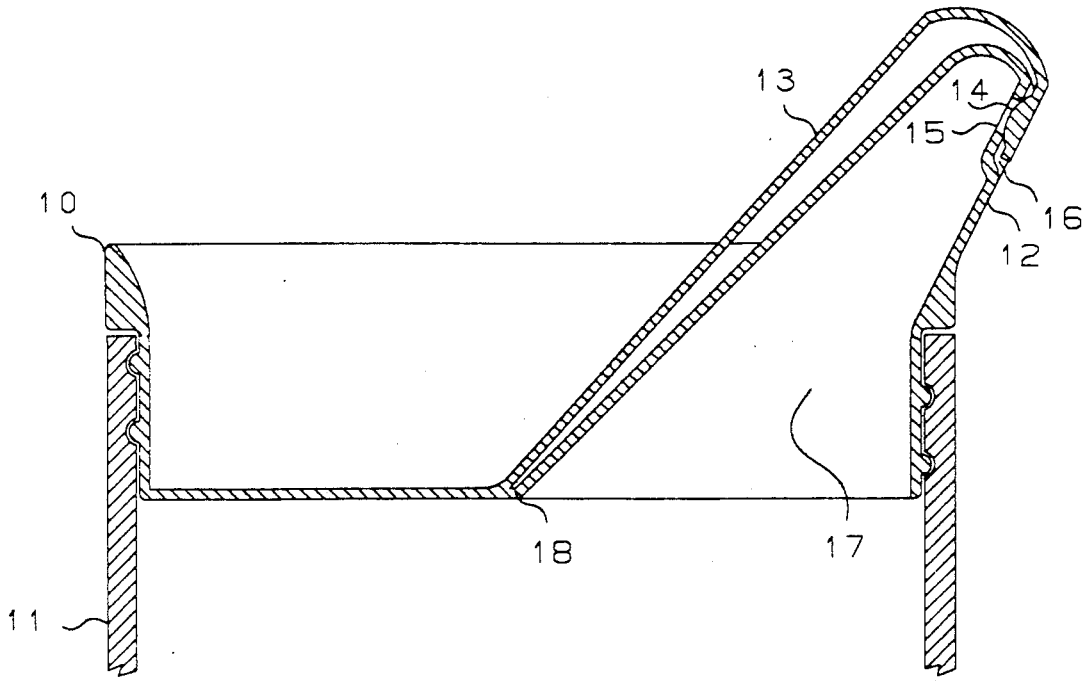
FIG. 4 is the cross-sectional view taken as indicated by section line 4—4 applied to FIG. 3.
Figure 4A:
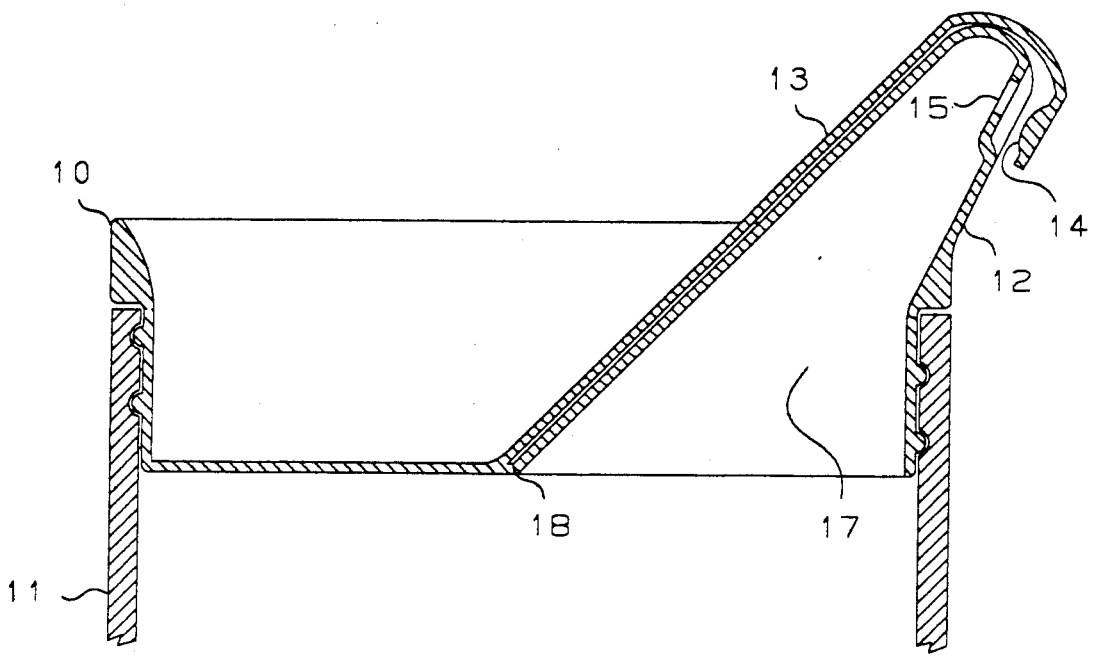
FIG. 4A is the cross-sectional view in FIG. 4, but FIG. 4A shows the closure in the opened position as a result of lip pressure applied by the user.
Figure 4B:
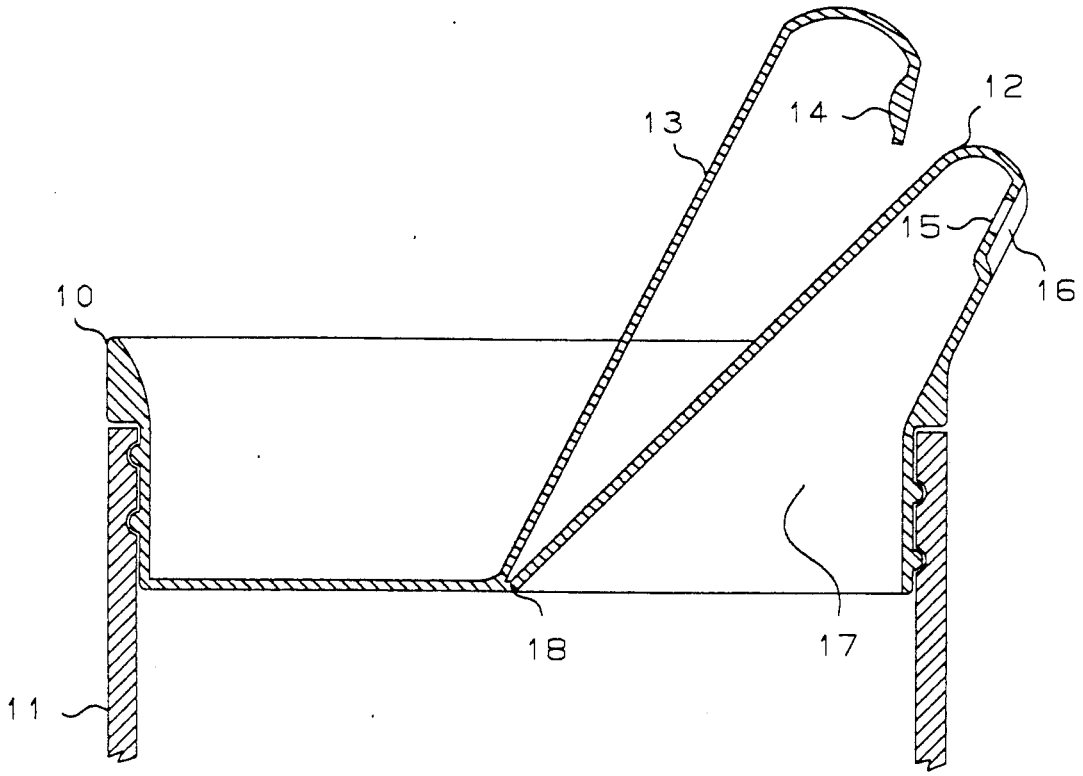
FIG. 4B is the cross-sectional view in FIG. 4, but FIG. 4B shows the closure in the manufactured position.

Another alternative for similar purposes is specifically shown in FIGS. 3 through 4C wherein the deflectable member 13 extends around the upper end of the spout 12 to the radially outward side thereof. Opening 15 and recessed area 16 are towards the radially outward side of the closure 10 near the upper end of the spout 12. The sealing member 14 is an integral part of the deflectable member 13, thus eliminating the need for stem 19 which is present in FIGS. 1 through 2C. The sealing member 14 sealingly engages with the opening 15 external to the spout 12 as opposed to internal to the spout 12 in the previous embodiment. In all other respects the closure 10 functions as disclosed in FIGS. 1 through 2C and in the written description pertaining thereto.

OPERATION - FIGS. 1—2B

After the closure 10 is manufactured to the form shown in FIG. 2B, the deflectable member 13 is deflected towards the spout 12 so that sealing member 14 is forced through the opening 15 in the spout 12. Now the closure 10 is in the closed position and takes the form shown in FIG. 2. Since the deflectable member 13 is biased to its manufactured position, the sealing member 14 will remain sealingly engaged with the opening 15 unless external pressure is applied to the deflectable member 13. The closure 10 is ready for use and can be attached to the container 11.

When consumption of the beverage in container 11 is desired, the spout 12 and the deflectable member 13 are inserted into the mouth of a user. External lip pressure applied by the user will cause the deflectable member 13 to move into intimate contact with spout 12, thus disengaging the sealing member 14 from the opening 15, as shown in FIG. 2A. This provides communication between the interior of the container 11 and the user's mouth which allows for delivery of the contained beverage. When the lip pressure is released the deflectable member 13, being biased to its manufactured position, will cause the sealing member 14 to sealingly engage with the opening 15, as shown in FIG. 2, thus denying communication between the interior and exterior of the container 11. This closed position makes the closure 10, with the container 11 attached, a spill-proof device even if tipped or overturned.

SUMMARY, RAMIFICATIONS, AND SCOPE

The closure of the present invention provides the following advantages over prior embodiments:

1) The closure will eliminate spills even if the device is tipped or overturned.

2) It will be possible to drink from the container in a normal manner without removing the closure from the container.

3) The closure is a simple structure and may easily be manufactured on conventional plastic forming machines, thus it may be inexpensively mass produced.

While embodiments of the invention have been described in detail, it is understood that other modifications and various embodiments thereof may be devised by one skilled in the art without departing from the spirit and the scope of the invention, as defined by the claims.

We claim:

1. A controllable valved closure for use in dispensing a beverage from a container, said closure comprising:

(a) a substantially planar cover portion conforming in shape to the opened end of said container;

(b) attachable means for selectively maintaining said closure in covering relation with said container;

(c) an elongated passageway having an outer end, said passageway extending upwardly and outwardly from said cover portion;

(d) a recessed area positioned on the outer surface of said passageway near said outer end and facing the central axis of said closure;

(e) a circular opening located within said recessed area, said opening providing communication between the interior and exterior of said passageway, and said opening being completely contained within the user's mouth during operation of the closure;

(f) an external deflectable member having attachable means for attaching said deflectable member to the outer surface of said closure, said deflectable member extending upwardly and outwardly along the outer surface of said passageway in close proximity with the outer surface of said passageway, said deflectable member being made of a flexible plastic which can be repeatedly stressed and unstressed, and retain memory of its original position, said deflectable member being depressible when inserted between the upper and lower lip of the user when lip pressure is applied, said deflectable member being biased so as to automatically return to its original position upon removal of lip pressure; and (g) a substantially hemispherical sealing member having a stem portion which provides selective spacing of said sealing member from said deflectable member, said sealing member functioning to provide sealing engagement of said opening when lip pressure is removed from said deflectable member.

2. The controllable valved closure according to claim 1 wherein said deflectable member attachable means includes an integral connection between said deflectable member and the outer surface of said closure.

3. The controllable valved closure according to claim 1 wherein said sealing member is between 0.001 inches and 0.010 inches larger than said opening.

4. The controllable valved closure according to claim 1 wherein said deflectable member is made of polypropylene.

5. A controllable valved closure for use in dispensing a beverage from a container, said closure comprising:

(a) a substantially planar cover portion conforming in shape to the opened end of said container;

(b) attachable means for selectively maintaining said closure in covering relation with said container;

(c) an elongated passageway having an outer end, said passageway extending upwardly and outwardly from said cover portion;

(d) a recessed area positioned on the outer surface of said passageway near said outer end and facing the central axis of said closure;

(e) an opening located within said recessed area, said opening providing communication between the interior and exterior of said passageway, and said opening being completely contained within the user's mouth during operation of the closure:

(f) an external deflectable member having attachable means for attaching said deflectable member to the outer surface of said closure, said deflectable member extending upwardly and outwardly along the outer surface of said passageway in close proximity with the outer surface of said passageway, said deflectable member being depressible when inserted between the upper and lower lip of the user when lip pressure is applied, said deflectable member being biased so as to automatically return to its original position upon removal of lip pressure; and (g) a sealing member positioned in the interior of said passageway, said sealing member having means for attaching to said deflectable member, said means comprising a stem which selectively spaces said sealing member from said deflectable member, said stem being integrally connected to said sealing member, said sealing member sealingly engaging said opening in the closed position and disengaging said opening in the opened position upon application of lip pressure to said deflectable member.

6. The controllable valved closure according to claim 5 wherein said deflectable member attachable means includes an integral connection between said deflectable member and the outer surface of said closure.

7. The controllable valved closure according to claim 5 wherein said stem is integrally connect to said deflectable member.

8. The controllable valved closure according to claim 7 wherein said deflectable member is positioned on an upper outer surface of said passageway said upper outer surface facing the central axis of said closure.

9. The controllable valved closure according to claim 8 wherein said opening is circular in shape and said sealing member is substantially hemispherical in shape.

10. The controllable valved closure according to claim 9 wherein said sealing member is between 0.001 inches and 0.0150 inches larger than said opening.

11. A controllable valved closure for use in dispensing a beverage from a container, said closure comprising:

(a) a substantially planar cover portion conforming in shape to the opened end of said container;

(b) attachable means for selectively maintaining said closure in covering relation with said container;

(c) an elongated passageway having an outer end, said passageway extending upwardly and outwardly from said cover portion;

(d) an opening in said closure which communicates between the interior and exterior of said passageway near its outer end whereby said opening is completely contained within the users mouth during operation;

(e) an external deflectable member having attachable means for attaching said deflectable member to the outer surface of said closure, said deflectable member extending upwardly and outwardly along the outer surface of said passageway and in close proximity with the outer surface of said passageway, said deflectable member being depressible when inserted between the upper and lower lip of the user when lip pressure is applied, said deflectable member being biased so as to automatically return to its original position upon removal of lip pressure; and (f) a sealing member for sealing said opening, said sealing member having means for attaching to said deflectable member, said sealing member functioning to provide sealing engagement of said opening in the closed portion, said sealing member becoming disengaged from said opening in the open position upon application of lip pressure applied to said deflectable member.

12. The controllable valved closure according to claim 11 wherein said deflectable member attachable means to said closure is an integral connection.

13. The controllable valved closure according to claim 11 wherein said passageway further includes a recessed area on the outer surface of said passageway near said outer end of said passageway, said opening being located within said recessed area.

14. The controllable valved closure according to claim 13 wherein said opening is circular in shape and said sealing member is substantially hemispherical in shape.

15. The controllable valved closure according to claim 14 wherein said deflectable member forms a J-shaped member which extends around said outer end of said passageway to the radially outward side of said closure.

16. The controllable valved closure according to claim 14 wherein said closure further includes a stem which selectively spaces said sealing member from said deflectable member, said stem being an integral part of said sealing member and of said deflectable member.

17. The controllable valved closure according to claim 15 wherein said opening and said recessed area are located on the radially outward side of said closure.

18. The controllable valved closure according to claim 16 wherein said sealing member is between 0.001 inches and 0.0150 inches larger than said opening.

* * * * *